United States Patent [19]

Wilson

[11] Patent Number: 4,775,149

[45] Date of Patent: Oct. 4, 1988

[54] SPRING-TYPE EXERCISE DEVICE

[76] Inventor: Robert M. Wilson, P.O. Box 353, Vanceboro, N.C. 28586

[21] Appl. No.: 45,073

[22] Filed: May 1, 1987

Related U.S. Application Data

[63] Continuation-in-part of Ser. No. 599,892, Apr. 13, 1984, abandoned.

[51] Int. Cl.[4] ..... A63B 21/02

[52] U.S. Cl. ..... 272/141; 272/137

[58] Field of Search ..... 272/135, 137, 141, 142; 267/180

[56] References Cited

U.S. PATENT DOCUMENTS

| | | | |
|---|---|---|---|
| 818,242 | 4/1906 | Geisel | 272/141 |
| 3,058,705 | 10/1962 | Hagg et al. | 267/180 X |
| 3,544,106 | 12/1970 | Barrett | 272/137 |
| 3,761,083 | 9/1973 | Buchner | 272/137 |

FOREIGN PATENT DOCUMENTS

| | | | |
|---|---|---|---|
| 84925 | 5/1920 | Switzerland | 272/141 |
| 249890 | 5/1948 | Switzerland | 272/141 |
| 9899 | of 1909 | United Kingdom | 272/141 |

*Primary Examiner*—Steven A. Bratlie
*Assistant Examiner*—J. Welsh
*Attorney, Agent, or Firm*—C. Robert Rhodes; Judith E. Garmon

[57] ABSTRACT

An elongated shaft includes a spring anchoring point at each end and in the center. A pair of sleeves are slidably positioned on the shaft, one between the central anchoring point and each end anchoring point. Each sleeve is joined to the anchor point on either side thereof by a coil spring. Each coil spring is identical in length and tension strength, and is formed from steel wire of a selected gauge. The coil spring tension strength of all the springs on the bar is modified by varying the width distance between each coil turn in a selected segment or segments of each spring. In use, each spring may be compressed toward or extended away from the associated anchor point, depending upon the particular exercise.

4 Claims, 4 Drawing Sheets

SPRING-TYPE EXERCISE DEVICE

REFERENCE TO RELATED APPLICATIONS

This application is a continuation-in-part of my copending application, Ser. No. 599,892 filed on Apr. 13, 1984 now abandoned.

BACKGROUND AND SUMMARY OF THE INVENTION

In recent years, people have become increasingly more interested in exercising. Such interests include exercises of all types such as jogging, rope skipping, swimming, aerobics, and muscle building and toning. Various muscle building and toning devices have evolved, such as free weights, Nautilus equipment, and the like. Some types of muscle building and toning equipment utilize the concept of combining both isometrics and isotonics. The present invention is directed to such an apparatus; a spring-type device used alone or in combination with other types of exercises including aerobics.

Previous spring-type exercise devices appear in prior art including U.S. Pat. Nos. 818,242 issued Apr. 17, 1906; 3,174,343 issued Mar. 23, 1965; 3,544,106 issued Dec. 1, 1970; 3,971,255 issued July 27, 1976; and 3,761,083 issued Sept. 25, 1973. Additionally, Swiss Pat. No. 84925 dated July 21, 1919 discloses a spring-type exercise bar. Each of these units has applicability for the uses and situations described therein. However, all are different from the device of the present invention and all fall short of being a universal exercise device capable of being used alone or in combination with other body exercises, particularly aerobics. In this regard, these known devices are generally limited to use in situations where the hands manipulate the device only in front of the chest or sometimes in situations where the knees compress or extend the spring units. In general, such devices cannot be used with the hands in different positions to the side, behind the head, or behind the back to exercise different muscles; nor can these devices be used in combination with other body exercises as described hereinafter.

The exercise device according to the present invention is directed to an elongated, continuous shaft having end spring anchoring means stationarily associated with the shaft at each end thereof and a central spring anchoring means stationarily associated with the shaft at a point substantially midway between the ends. A first sleeve is slidably mounted on the shaft substantially halfway between the central spring anchoring means and one of the end spring anchoring means. A second sleeve is slidably mounted on the shaft substantially halfway between the central spring anchoring means and the other of the end spring anchoring means. A spring connects each end of each of the sleeves with the adjacent spring anchoring means, so that the sleeves may be gripped and moved in either direction toward and away from an anchoring means, while compressing the spring on one side thereof and applying tension to the opposite spring.

In more preferred embodiments, the sleeves are separated by a distance greater than the width of the shoulders of the person for whom the device is intended. By lengthening or shortening the central spring anchoring means the rod accomodates persons of varying height. The length from one sleeve to the opposite end is substantially the same distance as from the ground to the shoulder of the person for whom the device is intended. Because the length of the exercise bar is somewhat determined by the height of the person who will be using it, and because the springs are positioned on the outside of each sleeve or grip position, the user has the ability to extend his or her hand positions along the length of the shaft, allowing the user to move the arms and the bar from the front of the body, up over the head, and down behind the back. Such an exercise results in the beneficial effects of a near maximum stretching motion which works the muscles and tendons of the upper chest, shoulders, upper arms and upper back.

The spring characteristics are novel in that tension variations are achieved by a unique means, and further in that when a sleeve is moved in one direction, the elastic limit of the springs on either side thereof are not exceeded. Finally, the length, diameter, modulus of elasticity, and all other characteristics of the spring units are substantially the same.

The aforementioned tension variations in the springs are achieved by uniquely varying the distance between the coil turns by as much as one-quarter inch to one-half inch along the full length of the spring. For example, in a spring that has a total length of six inches, the coil turns in a one-inch segment might be one-quarter inch apart, while coil turns for the adjacent five inches of spring might be one-half inch apart. Variations may be made along the full length of the spring or in a segment or segments thereof. One gauge of steel wire is utilized for all the springs on the exercise bar. The length of the springs is not varied; only the coil turns per inch in a prescribed segment or segments.

With a device of this type, there are several important relationships to understand which allow performance of various types of exercises not available with known equipment. In addition to the normal exercises to be performed with a spring-type exercise device, the fact that the length from one movable sleeve to the opposite end of the exercise bar is about the same as the shoulder height of the operator, allows the unit to be grasped at one end with the user's arms straight out in front of the body, with the opposite end of the exercise bar on the floor. The operator may then push down on the springs with weight against the floor, with the arms either extended in front, to one side or the other; or the user may place the elongated shaft behind himself and push down with the arms behind the head. The fact that the characteristics of the springs are such that if a movable sleeve is moved in one direction as far as possible, the elastic limit of the spring under tension is not exceeded allows maximum use of the device for the exercises explained immediately hereinabove.

Each movable sleeve moves in either direction toward a stationary element or anchor, so that one movable sleeve is never pushing against or pulling away from the other movable sleeve, but against and away from respective anchoring points. Further, while the two movable sleeves are spaced apart a distance greater than the shoulder width of the user, the central anchoring means allows the user to grasp one movable sleeve and the central anchoring means such that the hands may be closer together for certain exercises.

The central anchoring means is stationarily mounted—not a movable sleeve—and serves, in some types of exercises, as a stationary gripping surface. Because it serves as a gripping surface, and also because the central portion of the exercise bar is sometimes positioned behind the head and across the shoulders of the user, the surface must be substantially smooth. While the surface may be textured to improve the grip, there should be no ridges, knobs or handles, or other such projections associated with the central, anchoring means. Further, the fact that the central anchoring means is a surface denomination of the continuous elongated bar, and is not a joint, the overall strength of the exercise bar is improved. Many of the prior art devices are not continuous and are separable or jointed at the midportion, all to the detriment of the device.

The present invention on the other hand is a continuous, spring-loaded compression device which can be compressed inwardly or outwardly without making mechanical adjustments. Also, these movements may be made without changing handgrip positions and from a wide variety of arm positions which provide highly developmental exercise effects.

As a user changes positions, a different set of muscle groups is affected. Since the muscle groups worked and developed by the device are those most directly related to personal appearance and good posture, the present invention will provide most of the upper body exercise necessary to fitness. Combining use of the present invention with rope jumping or other aerobics, creates an unbeatable fitness program for men and women of all ages.

The invention can be used as a cardiovascular conditioner if the exercise movements are performed at a steady rate for prolonged periods of time. This means changing arm positions every few moments and keeping a rhythmic, in-out pumping action going for ten minutes or more. For people who are limited to the use of upper body exercises to achieve cardiovascular training, the present invention is especially appropriate.

It is therefore an object of the present invention to provide a universal spring-type exercise device, of improved strength and durability, and capable of use with a variety of different types of exercises.

Another object of the present invention is to provide an exercise device of the type described which may be used either alone or in conjunction with other types of body exercises.

Still another object of the present invention is to provide an exercise device of the type described, which may combine isotonic and isometric exercises with other exercises in a way not previously known.

Other objects and a fuller understanding of the present invention will become apparent from reading the following detailed description of a preferred embodiment along with the accompanying drawings in which.

DETAILED DESCRIPTION OF A PREFERRED EMBODIMENT

Figure 1:
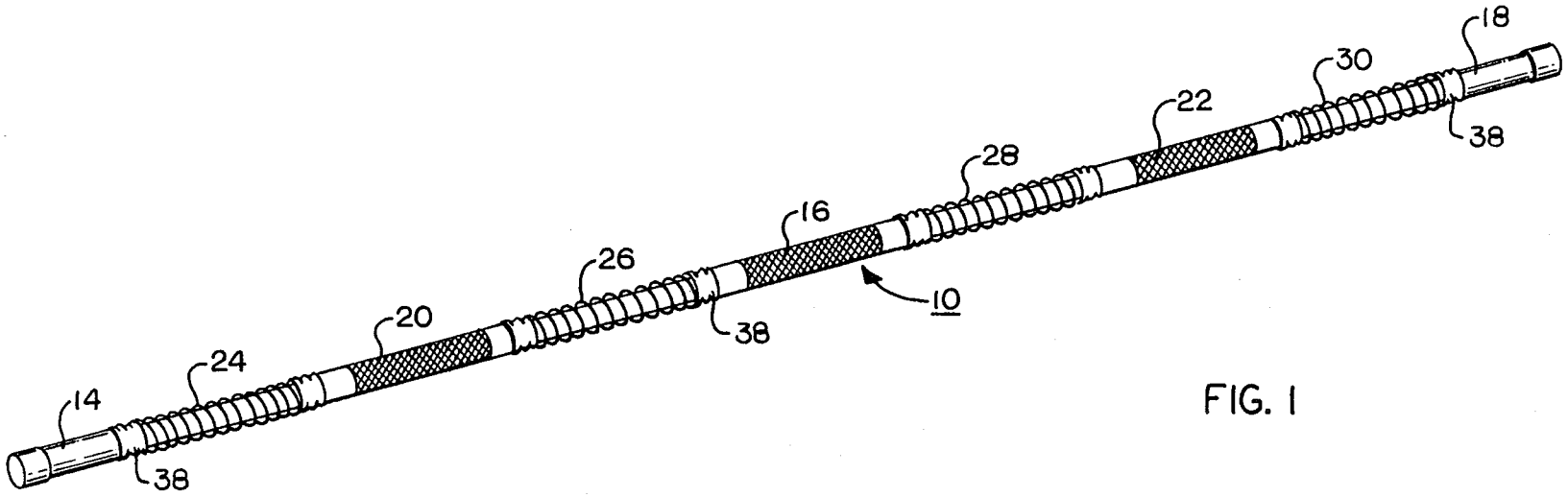
FIG. 1 is a perspective view of the exercise device according to the present invention.

Turning now to the drawings, FIG. 1, illustrates the exercise device 10 according to a preferred embodiment of the present invention. In general, the spring-type exercise bar includes an elongated shaft 12 which supports various sleeves, spring anchoring devices, and springs. First of all, shaft 12 is a continuous body on which end spring anchoring means 14 and 18 are attached at either end. The anchoring means cylindrical sleeves of a slightly greater diameter than shaft 12 and are immovably tack welded or otherwise permanently attached to the shaft. A central spring anchoring means 16 is also an immovable sleeve of a diameter slightly greater than support shaft 12, and is welded or otherwise secured on the shaft at a point substantially midway between the end spring anchoring means 14 an 18.

Sleeves 20, 22 form first and second gripping means and are sleeves which are slidably mounted to shaft 12; each substantially halfway between the central spring anchoring means 16 and one of end spring anchoring means 14 or 18. Sleeves 20 and 22 are also of a diameter slightly greater than the diameter of shaft 12; however, in contradistinction to sleeves 16 and 18, sleeves 20 and 22 are unattached to shafts 12 and therefore are free to slide.

Springs 24, 26, 28, and 30 surround shaft 12 and are interposed between end spring anchoring means 14, first sleeve 20, central spring anchoring means 16, second sleeve 22, and the other end spring anchoring means 18 respectively. Each of springs 24, 26, 28, and 30 are of substantially the same characteristics, i.e. lengths, diameter, modulus of elasticity, and the like. So arranged, these springs maintain or bias each of slidable sleeves 20, 22 substantially midway between the anchoring means 14, 16 and 18 on either side thereof.

Figure 2:
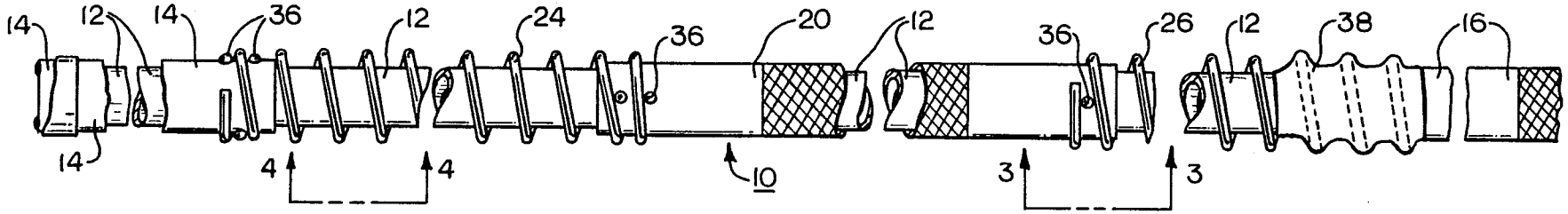
FIG. 2 is an enlarged side view, with portions thereof cut away, of the exercise device according to FIG. 1.

A small stud 36 extends radially from the surface of the ends of anchoring means 14, 16, and 18 and the slidable sleeves 20, 22, and provide a hook-type projection for securing the ends of springs 24, 26, 28, and 30 thereon as illustrated in FIG. 2. A heat shrinkable tube or polymeric tubular material 38 is then placed over the point at which each spring is anchored to its associating anchoring means for the purpose of helping to retain the spring thereon and to provide a more pleasing appearance.

So arranged, the slidable sleeves 20 and 22 may be moved in either direction toward an adjacent anchoring means causing a compression of one of the springs 24–30 on the side of the slidable sleeve 20, 22 toward which the sleeve is being moved and a tension on the spring on the opposite side thereof. Thus, the sleeves 20 and 22 are always being pushed toward an anchoring means and away from an anchoring means, and never work directly against each other. As such, the user can combine isotonic and isometric exercises to provide strengthening and toning of the muscles without shifting the hand placement.

Figure 2A:
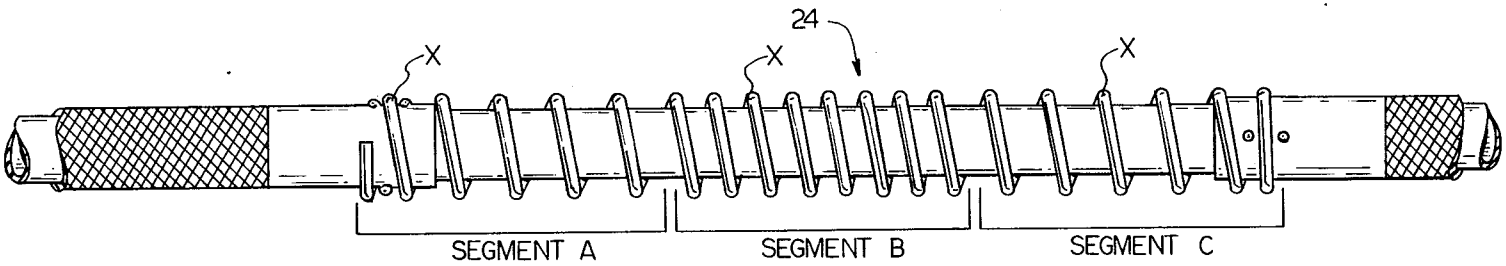
FIG. 2A is an enlarged view of one of the springs, showing the varied distance between coil turns along the length of the spring.
Figure 3:
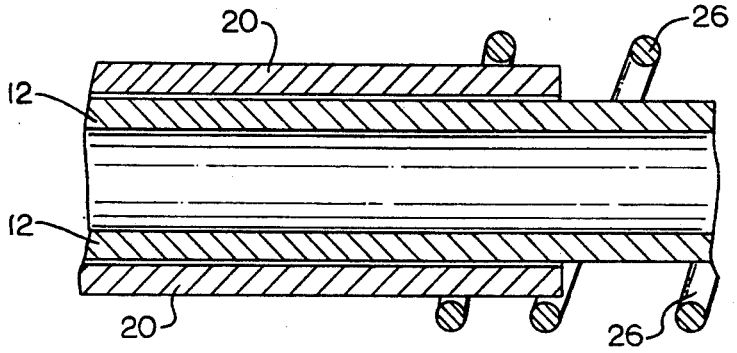
FIG. 3 is an enlarged side view of a portion of the device taken substantially along lines 3—3 of FIG. 2.
Figure 4:
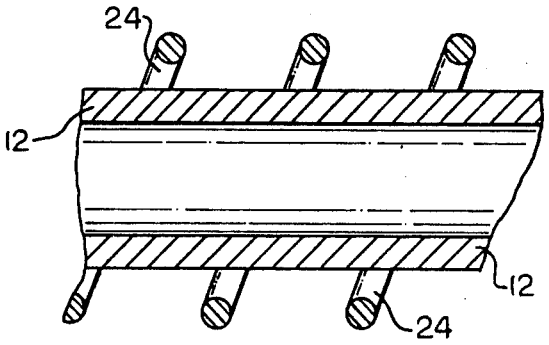
FIG. 4 is also an enlarged side view of another portion of the device taken substantially along lines 4—4 of FIG. 2.

As previously discussed, tension variations in the springs are achieved by uniquely varying the distance between the turns in the coil, and by making these variations in one of more prescribed segments of the total length of the spring. This technique is illustrated in FIG. 2A where segment A of spring 24 has coil turns "x" which are approximately one-half inch distance apart; segment B has coil turns "x" one-quarter inch in distance apart; and segment C has coil turns "x" one-half inch in distance apart. These distances and segment denominations as illustrated are for example only. In a given spring 24, 26, 28 or 30, there may be one varied coil segment, two or more, or all coil turns in the length of the spring may be equidistant. The springs 24, 26, 28, and 30 are thus constructed so that when one of the sleeves 20, 22 is moved in one direction to its maximum deflection, the elastic limit of the spring under tension is not exceeded.

When the user couples the use of the exercise device with the body movements and positions pictured in FIGS. 5–10, there is provided an additional stretching of the muscles. Thus, all aspects of exercise are accomplished, i.e. strengthening, flexibility and endurance.

In a preferred embodiment there are several relationships between the elements of the exercise device 10 which are important in order to maximize the effects to be achieved by utilizing the device. For example, sleeves 20 and 22 are separated by a distance greater than the shoulder width of the person for which the device is intended. It should be pointed out that it is here in the central anchoring means 16 that adjustments are made in length to fabricate that the exercise device 10 is in several sizes. Each size is appropriate for a user of a selected height range and build. Further, when the exercise device 10 is utilized for certain exercises, such as that illustrated in FIGS. 8, 9, and 10, it is desirable for such exercises that the length from one sleeve 20 and 22 to the opposite end be about the same as the distance between the shoulder of the user and the floor.

Figure 5:
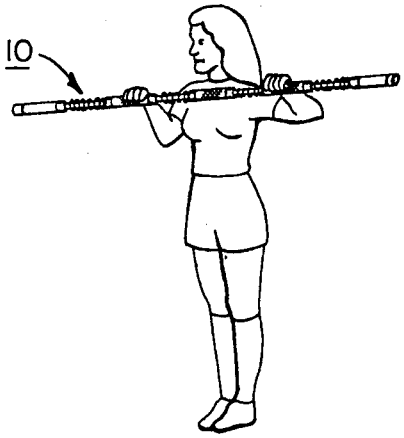
FIGS. 5-10 are environmental views showing the various types of exercises with which the exercise device of the present invention may be used.
Figure 6:
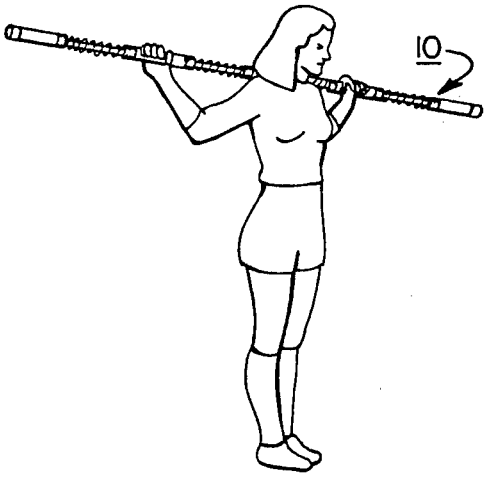
Figure 10:
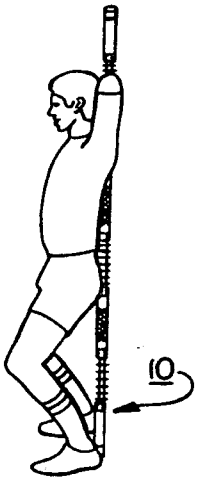
Figure 9:
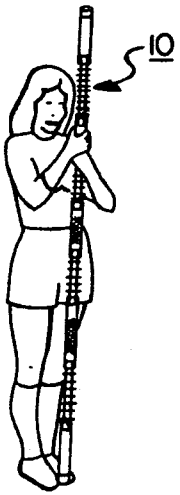
Figure 8:
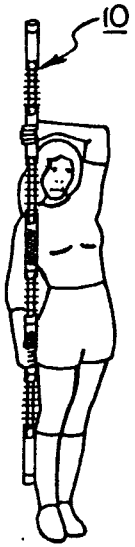
Figure 7:
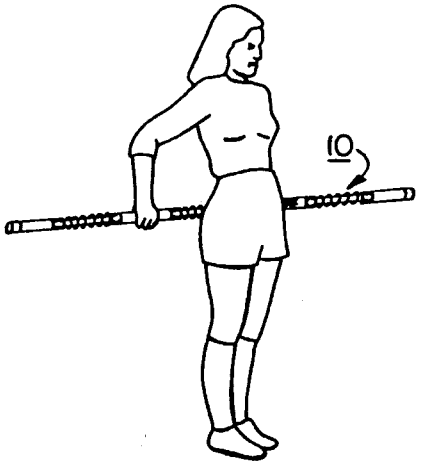

Turning now to FIGS. 5–10, there are illustrated various exercises with which the exercise device of the present invention is intended. In FIG. 5, the bar is held in front of the user and the sleeves 20, 22 grasped and either pulled together or pushed apart. Further, in addition to the FIG. 5 position, the bar may be held above the head for the same exercise, at the waist, or at the knees with the user bent from the waist. In FIG. 6 there is illustrated the position in which the bar is held above the shoulders behind the head. FIG. 7 is similar to FIG. 6 except the bar is held behind the torso. In FIG. 8, the bar is placed in an upright position on one side of the body. Obviously this position can be changed to the other side of the body. In FIG. 9, one end of the bar is placed on the floor and the user grasps the bar with his arms out front, and the bar is pushed against the floor or ground. In FIG. 10, the bar is again placed upright with the exception that the user grasps the bar behind his head and pushes down thereon. There are, of course, other exercises and the bar can be used for the strengthening and toning exercises while the user is jogging, jogging in place, or the like.

While a preferred embodiment of the present invention has been described in detail hereinabove, it is obvious that various changes and modifications might be made without departing from the scope of the invention which is set forth in the claims below.

What is claimed is:

1. An exercise device comprising:

(a) An elongated continuous unitary shaft;

(b) an end spring anchoring member stationarily positioned with respect to said shaft at each end thereof, and a central spring anchoring member stationarily positioned with respect to said shaft at a point substantially midway between said ends; said anchoring members being elongated along the length of said shaft and having a shape configuration which forms a gripping surface for the palm of a user's hand wherein the user of said exercise bar may selectively grip one or more of said anchoring members during performance of an exercise;

(c) a first sleeve slidably mounted on said shaft substantially halfway between said stationary central spring anchoring member and one of said end spring anchoring members;

(d) a second sleeve slidably mounted on said shaft substantially midway between said stationary central spring anchoring member and the other of said end spring anchoring members;

(e) a spring member attached to and connecting each end of each sleeve with the adjacent spring anchoring member, said spring members being of such characteristic as to maintain said sleeves in said midway position when not in use;

(f) whereby said sleeves may be moved in either direction toward or away from one of said anchoring members, by compresing the spring on one side thereof while simultaneously applying tension to the spring on the other side thereof.

2. The exercise device according to claim 1 wherein the shaft is variable in length to accommodate different size users.

3. The exercise device according to claim 1 and further wherein each of said springs are substantially identical in all characteristics.

4. The exercise device according to claim 3 wherein said coil springs are modified such that the distance between coil turns in at least one prescribed segment of each of said springs is varied in relationship to the distance between the remaining coil turns along the length of said spring.

* * * * *